US007351133B1

(12) United States Patent
Lemberger et al.

(10) Patent No.: US 7,351,133 B1
(45) Date of Patent: Apr. 1, 2008

(54) DISC GRINDING WHEEL WITH INTEGRATED MOUNTING PLATE

(75) Inventors: Michael J. Lemberger, Dudley, MA (US); Alan R. Balding, Inman, SC (US)

(73) Assignee: Saint-Gobain Abrasives Technology Company, Worcester, MA (US)

( * ) Notice: Subject to any disclaimer, the term of this patent is extended or adjusted under 35 U.S.C. 154(b) by 0 days.

(21) Appl. No.: 11/639,652

(22) Filed: Dec. 15, 2006

(51) Int. Cl.
*B23F 21/03* (2006.01)

(52) U.S. Cl. ..... 451/548; 451/546

(58) Field of Classification Search ..... 451/548, 451/540, 549, 550, 543, 546
See application file for complete search history.

(56) References Cited

U.S. PATENT DOCUMENTS

| | | | | |
|---|---|---|---|---|
| 2,048,905 | A * | 7/1936 | Webster | 451/548 |
| 2,926,469 | A * | 3/1960 | Kubsh | 451/548 |
| 3,540,163 | A * | 11/1970 | Shoemaker | 451/548 |
| 3,576,090 | A * | 4/1971 | Shoemaker | 451/548 |
| 3,795,078 | A | 3/1974 | Coes, Jr. | |
| 4,240,230 | A | 12/1980 | Ferrantini | |
| 4,694,615 | A | 9/1987 | MacKay, Jr. | |
| 4,754,577 | A | 7/1988 | MacKay, Jr. | |
| 4,754,578 | A | 7/1988 | MacKay, Jr. | |
| 4,760,670 | A | 8/1988 | MacKay, Jr. | |
| 4,878,316 | A | 11/1989 | MacKay, Jr. | |
| 4,896,463 | A | 1/1990 | MacKay, Jr. | |
| 4,899,494 | A | 2/1990 | MacKay, Jr. | |
| 4,907,376 | A * | 3/1990 | Bouchard et al. | 451/548 |
| 4,924,634 | A | 5/1990 | MacKay, Jr. | |
| 4,934,107 | A | 6/1990 | MacKay, Jr. | |
| 4,979,336 | A | 12/1990 | MacKay, Jr. | |
| 5,031,361 | A | 7/1991 | MacKay, Jr. | |
| 5,152,106 | A | 10/1992 | MacKay, Jr. | |
| 5,408,983 | A * | 4/1995 | Sawluk | 125/15 |
| 6,988,937 | B2 | 1/2006 | Bonner et al. | |

FOREIGN PATENT DOCUMENTS

| | | |
|---|---|---|
| JP | 2190260 | 7/1990 |
| JP | 2002331454 | 11/2002 |
| RU | 2146599 | 3/2000 |

* cited by examiner

*Primary Examiner*—Dung Van Nguyen
(74) *Attorney, Agent, or Firm*—Sampson & Associates P.C.

(57) ABSTRACT

A bonded abrasive grinding wheel is provided with a bonded abrasive disc including abrasive grain disposed within a bond matrix, and a mounting plate integrally fastened to the disc. In various embodiments, the mounting plate has a plurality of non-metallic first threaded fastener portions disposed in a predetermined pattern therein, and is fabricated from a composition including a polymeric material. The non-metallic first threaded fastener portions are each configured for respective engagement with a plurality of second threaded fastener portions disposed along a face plate of a grinding machine.

44 Claims, 5 Drawing Sheets

DISC GRINDING WHEEL WITH INTEGRATED MOUNTING PLATE

BACKGROUND

1. Technical Field

This invention relates to abrasive grinding wheels, and more particularly to disc grinding wheels having integrated mounting plates to facilitate mounting to face plates of surface grinding machines.

2. Background Information

Abrasive (i.e., grinding) wheels are widely used on conventional grinding machines and on hand-held angle grinders. When used on these machines the wheel is held by its center and is rotated at a relatively high speed while pressed against the work (i.e., workpiece). The abrasive surface of the grinding wheel wears down the surface of the work by the collective cutting action of abrasive grains of the grinding wheel.

Grinding wheels are used in both rough grinding and precision grinding operations. Rough grinding is used to accomplish rapid stock removal without particular concern for surface finish and burn. Examples of rough grinding include the rapid removal of impurities from billets, the preparing of weld seams and the cutting off of steel. Precision grinding is concerned with controlling the amount of stock removed to achieve desired dimensional tolerances and/or surface finish. Examples of precision grinding include the removal of precise amounts of material, sharpening, shaping, and general surface finishing operations such as polishing, and blending (i.e., smoothing out weld beads).

Conventional face grinding wheels or surface grinding wheels, in which the generally planar face of the grinding wheel is applied to the workpiece, may be used for both rough and precision grinding, using a conventional surface grinder or an angle grinder with the planar face oriented at an angle up to about 6 degrees relative to the workpiece. Conventional face grinding or surface grinding wheels are often fabricated by molding an abrasive particulate and bond mixture, with or without fiber reinforcements, to form a rigid, monolithic, bonded abrasive wheel. An example of suitable bonded abrasive includes alumina, silicon carbide and alumina zirconia grain in a resin bond matrix. Other examples of bonded abrasives include diamond, CBN, alumina, or silicon carbide grain, in a vitrified or metal bond. Various wheel shapes as designated by ANSI (American National Standards Institute) are commonly used in face or surface grinding operations. These wheel types include cylinder wheels (Type 2), abrasive discs (wheels having flat, annular grinding faces), straight cup wheels (Type 6), flaring cup (Type 11), dish wheels (Type 12), and depressed center wheels (Types 27 and 28).

Many of these conventional face grinding or surface grinding wheels/discs, such as the Type 6 straight cup wheels or others having a recessed center, may be conveniently mounted to a spindle/arbor of a grinding machine simply by use of a threaded fastener that passes through a center hole of the wheel and tightens the wheel against one or more spindle flanges. However, in many other applications, e.g., by virtue of their configuration and/or relatively large size, it is desirable to fasten these wheels at multiple locations disposed radially outward from their center holes in a manner that does not disrupt the continuity of the grinding face.

As shown in FIG. 1, this engagement is typically accomplished by embedding threaded metallic nuts 20 into the back face of an abrasive disc 30. The nuts are engaged by bolts 22 passing through a flange or face plate 24 of a grinding machine. This approach advantageously provides a relatively large number of distributed contact points, which securely fastens even relatively large wheels to the grinding machine (e.g., with up to 64 nut and bolt combinations 20, 22, for a wheel of 42 inches (107 cm) in diameter). A drawback to this approach, however, is that such wheels may require as many as 64 nuts each, placed in accordance with bolt hole patterns that may vary depending on the type and size of the wheel, and on the grinding machine manufacturer. As such, the manufacture of these discs, including the process steps associated with embedding the nuts in accordance with the desired hole patterns, tends to be relatively time consuming and labor intensive.

For example, the nuts 20 are typically embedded by means of complex fixturing used during mold filling and pressing operations. The fixturing is removed prior to thermal curing operations, and without the support provided by the fixturing, the nuts tend to move as the disc cures during firing, creating alignment problems when discs are mounted on grinding machines.

Alternatively, a fixture may be used to support the nuts during molding. The threaded engagement of the fixture and nuts enables the disc and plate to be fired as a unit. Once firing is complete, the fixture is removed, e.g., by unscrewing it, to release the fixture from the fired discs. Although firing the discs with the attached fixture tends to minimize any movement of the nuts, this method effectively prevents the fixture from being reused until firing is completed, which requires one to maintain a relatively large number of fixtures on hand. This requirement adds to the already large number of discrete parts required of a typical abrasive disc manufacturing operation, which may require thousands of parts to manufacture discs in a desired range of sizes and types.

Referring to FIG. 2, other mounting approaches use a steel mounting plate 36 having drilled and tapped mounting holes configured to receive a threaded stud or bolt passing through face plate 24 of the grinding machine. As shown, plate 36 is cemented to a rear face of the disc 30. Although this approach may operate satisfactorily for some (e.g., small diameter) abrasive wheels, the additional weight and cost associated with metallic plates 24 suitable for large wheels, e.g., up to 44 inches (112 cm) and 300 lbs (136 kg) would tend to be prohibitive.

Thus, a need exists for an improved surface grinding abrasive disc and method for fastening the disc to a grinding machine.

SUMMARY

In one aspect of the invention, a bonded abrasive grinding wheel is provided with a bonded abrasive disc including abrasive grain disposed within a bond matrix, and a mounting plate integrally fastened to the disc. The mounting plate has a plurality of non-metallic first threaded fastener portions disposed in a predetermined pattern therein, and is fabricated from a composition including a polymeric material. The non-metallic first threaded fastener portions are each configured for respective engagement with a plurality of second threaded fastener portions disposed along a face plate of a grinding machine.

In another aspect of the invention, a method of fabricating a grinding wheel includes forming a mounting plate from a composition including a polymeric material, and disposing a plurality of non-metallic first threaded fastener portions in a predetermined pattern thereon, the first threaded fastener portions each being configured for respective engagement with a plurality of second threaded fastener portions disposed along a face plate of a grinding machine. The method also includes forming a bonded abrasive disc, and integrally fastening the plate to the abrasive disc.

In a still further aspect, a bonded abrasive grinding wheel is provided with a bonded abrasive disc including abrasive grain disposed within a bond matrix. A mounting plate fabricated from a composition including a polymeric material is integrally fastened to the abrasive disc. The mounting plate has a plurality of non-metallic first threaded fastener portions machined in a predetermined pattern therein, each configured for respective engagement with a plurality of second threaded fastener portions disposed along a face plate of a grinding machine. The disc has a diameter ranging from about 5 inches (13 cm) to about 44 inches (112 cm). The mounting plate has a yield strength of at least 40 MPa. The plurality of first threaded fastener portions each has a pullout strength of at least 500 pounds (2224 Newtons), and the grinding wheel has a burst strength of at least 10560 surface feet per minute (3219 surface meters per minute).

In yet another aspect of the invention, a bonded abrasive grinding wheel is provided with a bonded abrasive disc including abrasive grain disposed within a bond matrix. A mounting plate is integrally fastened to the disc, and has a plurality of first threaded fastener portions disposed in a predetermined pattern therein. The mounting plate includes a plurality of elongated supports extending radially and circumferentially between the first fastener portions, and is fabricated from a composition including a polymeric material. The first threaded fastener portions are each configured for respective engagement with a plurality of second threaded fastener portions disposed along a face plate of a grinding machine.

BRIEF DESCRIPTION OF THE DRAWINGS

The above and other features and advantages of this invention will be more readily apparent from a reading of the following detailed description of various aspects of the invention taken in conjunction with the accompanying drawings, in which.

DETAILED DESCRIPTION

Figure 1:
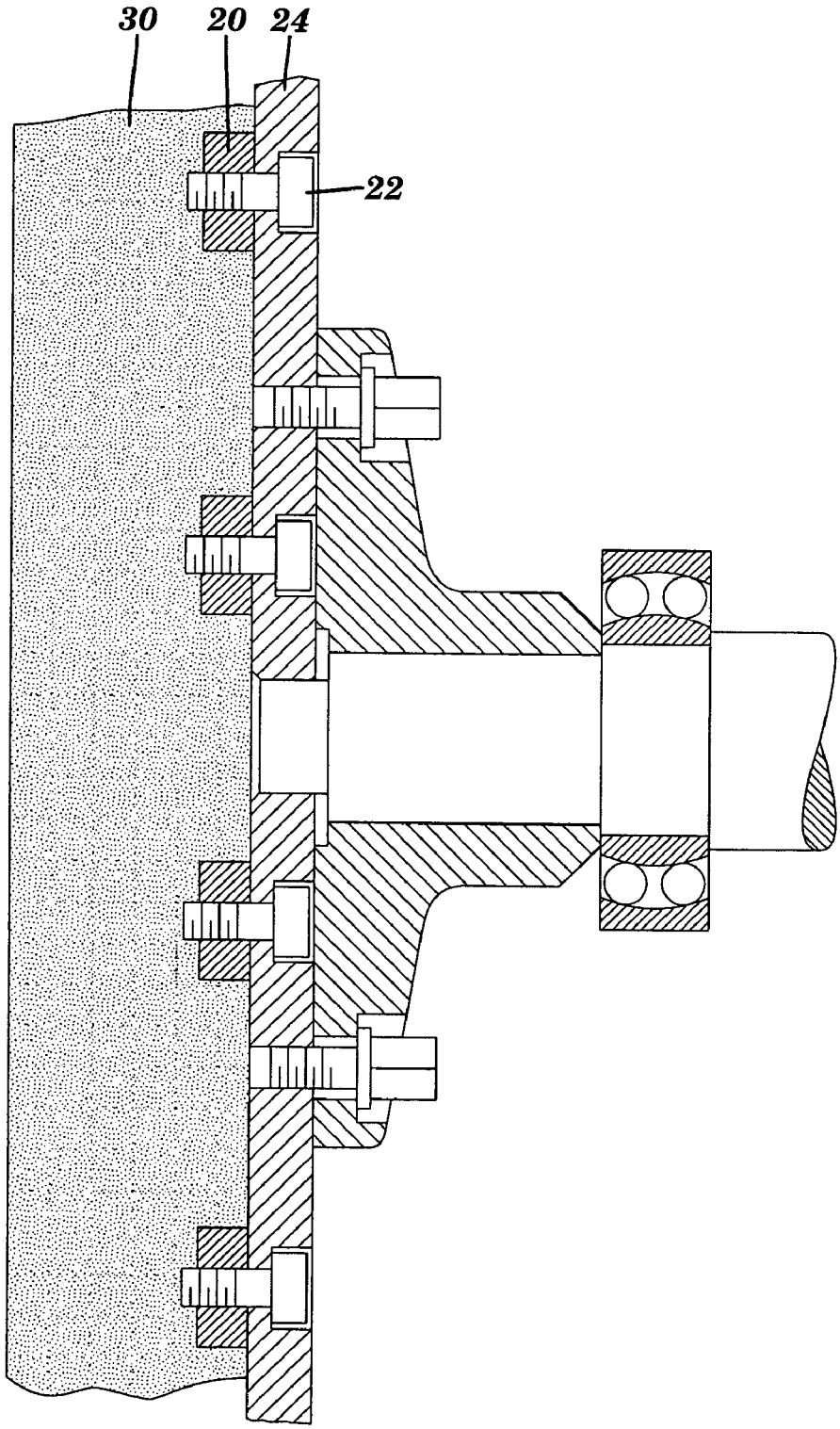
FIG. 1 PRIOR ART
FIG. 1 is a cross-sectional side view of a portion of an abrasive disc of the prior art, fastened to a face plate of a conventional grinding machine.
Figure 2:
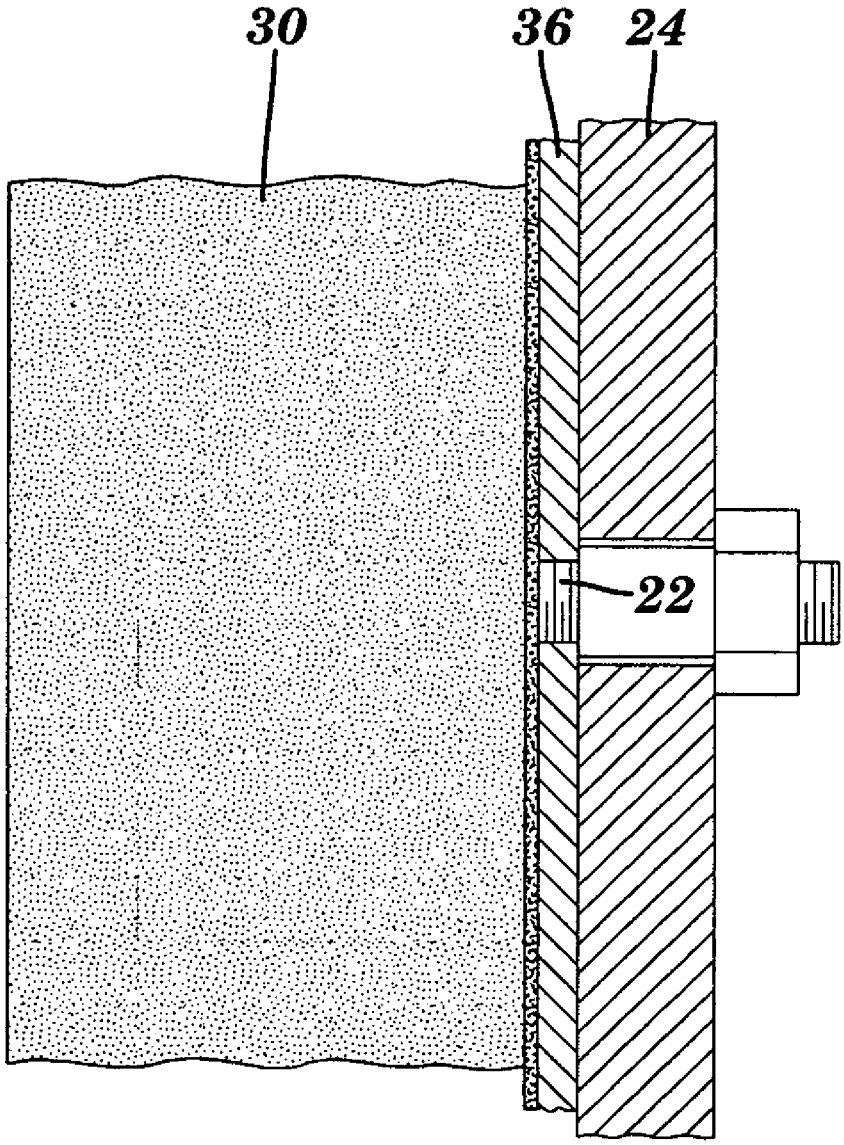
FIG. 2 PRIOR ART
FIG. 2 is a cross-sectional side view of a portion of another abrasive disc of the prior art, fastened to a portion of a face plate of a conventional grinding machine.

In the following detailed description, reference is made to the accompanying drawings that form a part hereof, and in which is shown by way of illustration, specific embodiments in which the invention may be practiced. These embodiments are described in sufficient detail to enable those skilled in the art to practice the invention, and it is to be understood that other embodiments may be utilized. It is also to be understood that structural, procedural and system changes may be made without departing from the spirit and scope of the present invention. The following detailed description is, therefore, not to be taken in a limiting sense, and the scope of the present invention is defined by the appended claims and their equivalents. For clarity of exposition, like features shown in the accompanying drawings are indicated with like reference numerals and similar features as shown in alternate embodiments in the drawings are indicated with similar reference numerals.

As discussed hereinabove with respect to FIG. 1, metallic nuts 20 are commonly molded into an abrasive disc 30 to provide a secure means of mounting the disc to the face plate 24 of a grinding wheel for face grinding operations. This approach has been shown to provide a structurally sound mounting for face grinding wheels of a wide range of sizes, e.g., having diameters ranging from 200 mm to 1067 mm (8-42 inch) or more.

As mentioned hereinabove, however, the ability to manufacture such a relatively large range of grinding wheel sizes tends to be costly from both an inventory management and labor perspective due to the large number (often many thousands) of discrete components that must be kept on hand. It is therefore desirable to reduce this number of parts, without compromising the ability to produce a wide range of wheel sizes and configurations.

While perhaps counterintuitive, the present inventors have found that by adding to the number of parts of a particular grinding wheel or disc, they have been able to simplify the manufacture thereof, to reduce the overall number of parts required to produce the wheels/discs. In addition, the present invention has been found to reduce the labor requirements of the manufacturing process.

Embodiments of the present invention have accomplished the foregoing by effectively moving threaded fastener portions (e.g., threaded nuts or bores) from the abrasive disc to a single discrete, mounting plate which may be fastened to the disc either before or after the disc is fired. This construction enables the relatively customized placement of the fastener portions to occur 'off-line' relative to the molding of the disc, to help simplify the otherwise relatively complex manufacture of the disc itself. By using the mounting plate to accurately locate and secure the threaded fastener portions, these embodiments eliminate the complexity associated with inserting pins, etc., to individually maintain each fastener in position within the wheel mold, and removing them once molding is complete.

Figure 3:
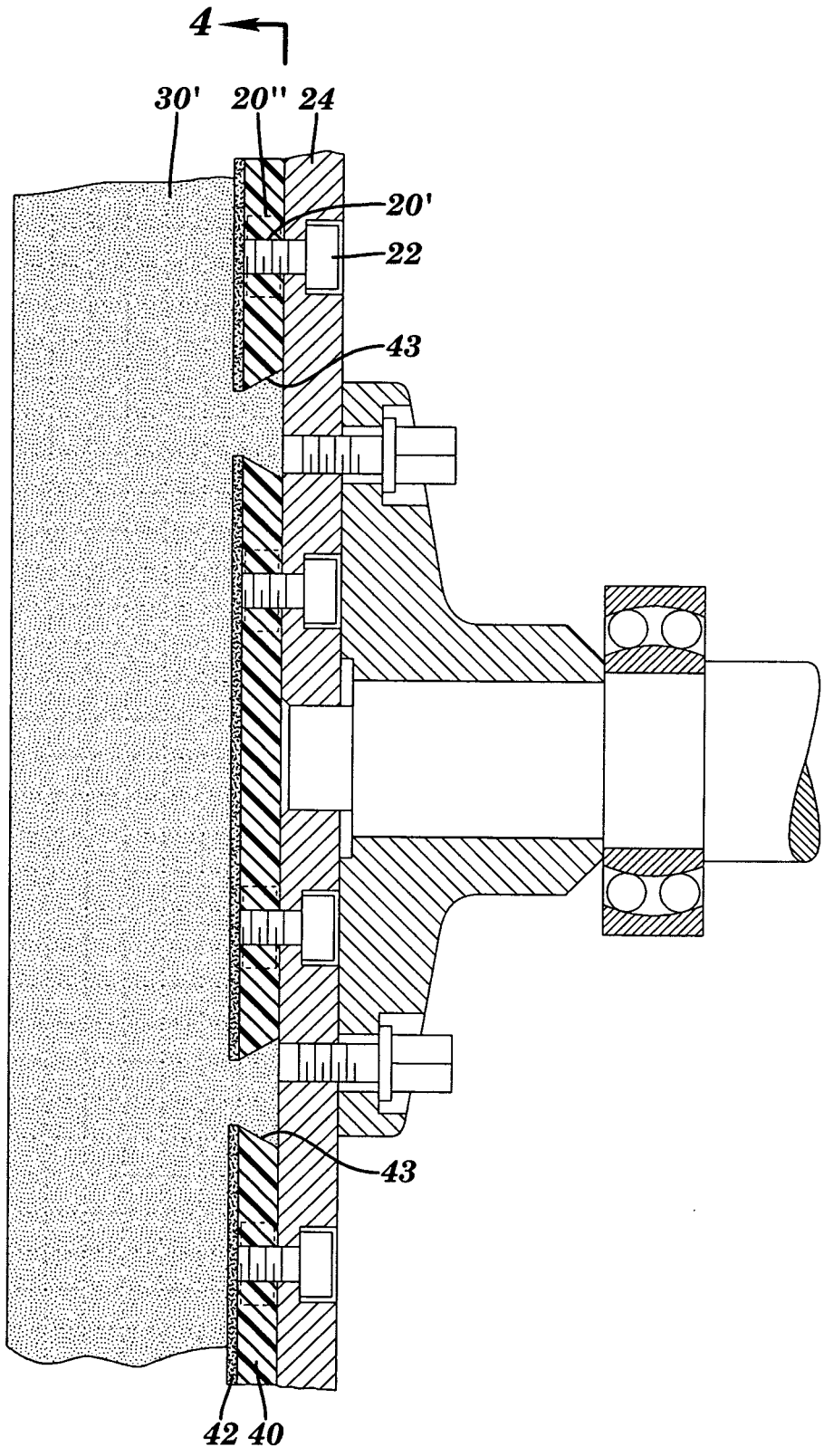
FIG. 3 is a cross-sectional side view of a portion of an embodiment of the present invention, fastened to a face plate of a conventional grinding machine.

Turning now to FIG. 3, an embodiment of the present invention includes a mounting plate 40 fabricated from a non-metallic material. Alternatively, plate 40 may be fabricated from metallic materials such as cast-iron or powdered metal (using conventional powdered metallurgy techniques). Plate 40 includes a plurality of fastener portions 20' disposed in a pattern that corresponds to a bolt pattern of face plate 24 of a particular conventional grinding machine. The mounting plate 40 may support abrasive disc 30' by use of one or more of a bonding agent 42, such as a cross-linked epoxy, and/or a mechanical interlock formed by mechanical engagement of the disc 30' with a ledge or tapered channel 43, to form a dovetail-type fastener as shown. This interlock may be formed by molding plate 40 in-situ with the disc 30' as discussed below. Thus, in this manner, abrasive disc 30' is secured to face plate 24 of a grinding machine, while effectively removing fastener portions 20' from the abrasive disc 30' itself. Moreover, fabricating plate 40 from a polymeric material such as a conventional thermoplastic or thermoset material, provides the plate with adequate mechanical strength and structural characteristics to support the abrasive disc 30' during grinding operations (discussed below) while keeping weight and cost relatively low.

To meet the desired mechanical and structural characteristics, embodiments are provided with a mounting plate having a diameter of at least 50 to about 90 percent that of the disc. The total cross-sectional area of the plates are within a range of 40 to 100 percent that of the disc for the embodiments of FIG. 4, and within a range of 5 to 27 percent that of the disk for the embodiments of FIG. 5, as discussed hereinbelow. Embodiments of the mounting plate have a yield strength of at least 40 MPa to 100 MPa according to the test method described hereinbelow with respect to Table II. The threaded fastener portions have a pull-out strength of at least 500 pounds (2224 Newtons), to about 1200 pounds (5338 Newtons), according to the test method described hereinbelow with respect to Table III.

Those skilled in the art will recognize that the completed grinding wheel assembly may experience relatively high centrifugal forces during operation, particularly at the wheel periphery, due to the relatively high speeds at which they are generally operated. Accordingly, completed embodiments described herein were tested by subjecting them to burst strength tests which involved subjecting them to rotational speeds of at least 1.76 times maximum operating speed. These embodiments all exhibited a burst strength of at least 10560 surface feet per minute (3219 surface meters per minute) or greater, (with some embodiments achieving over 14,000 surface feet per minute) to qualify them for maximum operating speeds of at least 6000 surface feet per minute (1829 surface meters per minute).

Substantially any material having the requisite mechanical strength and structural characteristics may be used for mounting plate 40, 40'. In particular embodiments, satisfactory materials include those having a yield strength of at least 40 MPa, with fastener portions 20' exhibiting a pullout strength (e.g., using standard ⅜-11 bolts) of at least 500 pounds (2224 Newtons). In other embodiments, a yield strength of 100-500 MPa is desired, with a pullout strength of at least 1200 pounds.

These requirements may be met by numerous polymeric materials, including various thermoplastic or thermoset materials, with or without fiber (e.g., aramid, carbon, glass) reinforcement. Examples of thermoplastics that may be suitable for some applications include Acrylonitrile butadiene styrene (ABS), Acrylic, Polyacetal (Acetal), Polyacrylates (Acrylic), Polyacrylonitrile (PAN or Acrylonitrile), Polyamide (PA or Nylon), Polyamide-imide (PAI), Polycarbonate (PC), and Polyvinyl chloride (PVC), and combinations thereof.

Moreover, use of a thermoset material having the desired yield and pullout strength enables plate 40 to be molded in-situ with abrasive disc 30', without re-melting when exposed to the heat and pressure associated with the otherwise conventional molding and curing operations, as discussed below. Exemplary thermosets include phenolic resins and polyester resins such as polycarbonate and polyethylene terephthalate (PET), optionally reinforced with fiber (e.g., fiberglass, carbon fiber, polymeric fiber and mineral fiber), and combinations thereof.

Abrasive discs 30' may be fabricated from substantially any abrasive/bond combination known to those skilled in the art of grinding wheels, and/or which may be developed in the future. Moreover, discs 30' may be advantageously fabricated in any desired manner, such as by use of conventional molding and firing techniques. In one representative example, disc 30' included about 38 volume percent (vol. %) abrasive grain, 14 vol. % bond, and 48 vol. % porosity. Other examples of suitable grinding wheel materials and fabrication techniques are disclosed in U.S. Pat. Nos. 5,658,360, 6,015,338 and 6,251,149 and U.S. Ser. No. 10/510,541, assigned to Saint-Gobain Abrasives, Inc., which are fully incorporated herein by reference.

In the embodiment shown, fastener portions 20' include threaded bores sized and shaped to threadably engage a mating fastener portion 22, such as a bolt or stud extending from machine face plate 24 as shown. An advantage of fastener portions 20' are that they may be conveniently formed after fabrication of the plate, e.g., by using a conventional CNC milling machine or drill press on an XY table, to drill and tap holes along nominally any desired pattern. Fastener portions 20' may also be conveniently molded into plate 40. Alternatively, the fastener portions may include threaded (e.g., non-metallic, or metallic in some embodiments) nuts 20" embedded within plate 40, as shown in phantom. In a still further embodiment, fastener portions may take the form of bolts or studs embedded into the mounting plate, which are sufficiently long to pass through and engage bores in face plate 24, and/or which are secured in position with threaded nuts.

As shown, these embodiments provide fastener portions 20', 20" along nominally any desired pattern without the need to individually position portions 20' within the abrasive disc 30'. Moreover, the absence of fixturing protruding into the disc 30' and the lack of any need to remove it from the disc after molding, tends to simplify manufacture of the disc 30', while reducing or eliminating the opportunity for stress concentrations and/or cracking generated thereby.

Figure 4:
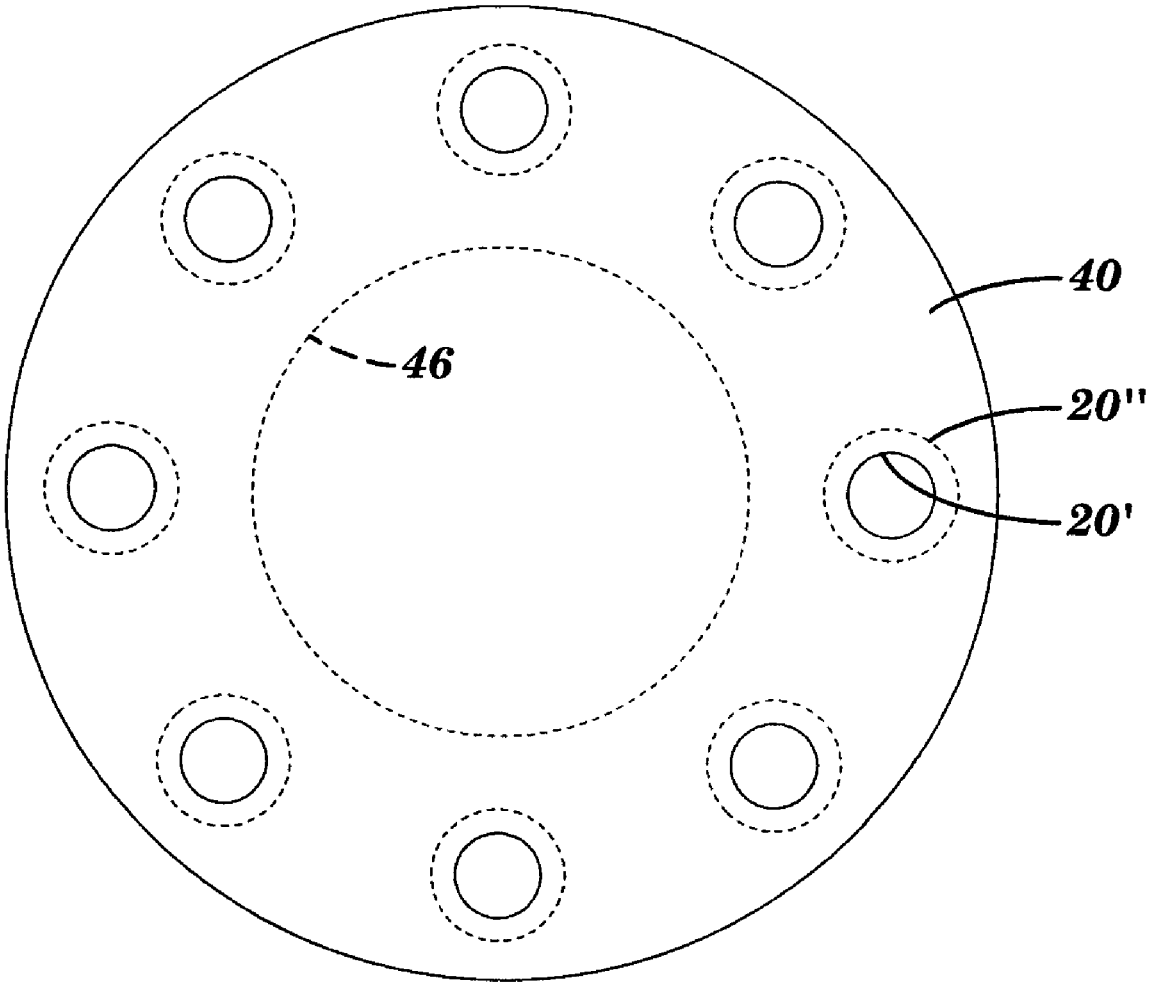
FIG. 4 is a view taken along 4-4 of FIG. 3, with optional portions shown in phantom, of a mounting plate of the present invention.
Figure 5:
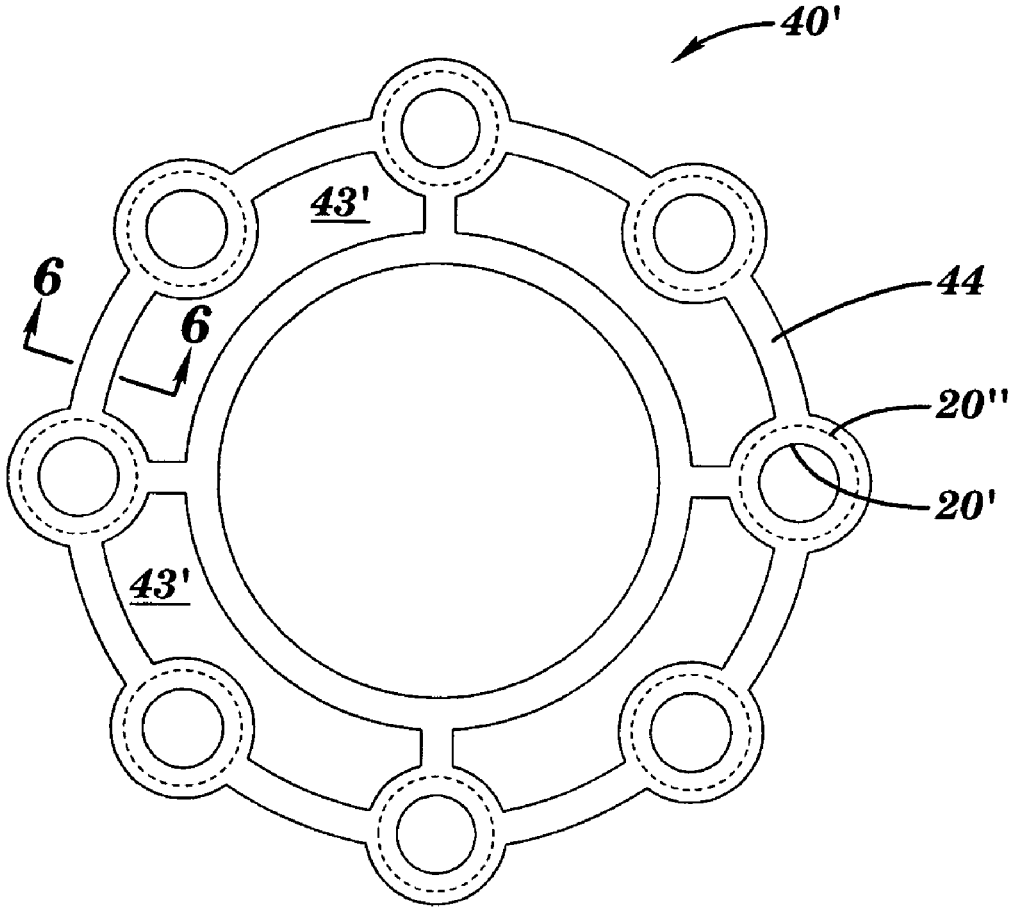
FIG. 5 is a view similar to that of FIG. 4, of an alternate embodiment of a mounting plate of the present invention.
Figure 6:
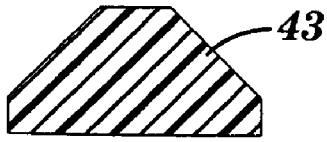
FIG. 6 is a view taken along 6-6, including optional aspects of the embodiment of FIG. 5.

Turning now to FIGS. 4-6, the mounting plate may be fabricated in any number of sizes and shapes capable of maintaining fastener portions 20', 20" at desired locations. For example, as shown in FIG. 4, mounting plate 40 may be formed as a substantially circular disc, i.e., having a circular transverse cross-section as shown. Depending on the particular application, plate 40 may be provided with or without a center hole, such as shown in phantom at 46. As discussed above, in particular embodiments, the plate 40 is provided with a transverse cross-sectional area within a range of about 50 to 100 percent, and more particularly, about 90 to 100 percent, that of the abrasive disc to which it is secured. The outer diameter of the mounting plate is at least 50 to about 90 percent that of the disc. In particular embodiments, the plate diameter ($P_d$) is at least one half the sum of the outer diameter and center hole diameter of the abrasive disc, as provided by Eq. 1.

$$P_d = (\text{Diameter of disc} + \text{Diameter of Hole})/2 \qquad \text{Eq. 1}$$

The plate is generally thick enough so that at least three threads of the bolt engage fastener portions 20', 20", without contacting disc 30'. In particular embodiments, this may be accomplished by providing plates with a thickness of at least ±2 (0.5) inches (1.27 cm), (preferably ⅝ (0.625) inches (1.6 cm) in particular embodiments) with a ⅝-11 bolt extending at least ¼ (0.25) inches (0.6 cm) into the fastener portions.

As shown in FIGS. 5 & 6, in an alternate embodiment, a mounting plate 40' may be fabricated as a series of individual fastener portions 20', 20", connected to one another by a network of supports 44, e.g., in a hub and spoke arrangement. In this embodiment, plate 40' may be provided with a transverse cross-sectional area (i.e., transverse to its axis of rotation) within a range of about 5 to 27 percent that of the abrasive disc 30' to which it is secured. This mounting plate 40' may be fastened to an abrasive disc 30' using an adhesive 42 as discussed hereinabove. In addition, and/or as an alternative, plate 40' may be conveniently molded in-situ with the disc 30', with or without adhesive 42, as will be discussed in greater detail hereinbelow. During molding, the network of supports 44 maintain the desired relative positioning of fastener portions 20', 20". Also, in this embodiment, optional interlock portions (ledges 43 of supports 44 (FIG. 6) and/or gaps 43' formed between supports 44), are engaged by, or substantially filled with, the abrasive/bond material during molding to form a mechanical interlock with the disc 30' to secure plate 40' to the disc 30'. In this manner, abrasive disc 30' may be provided with embedded fastener portions 20', 20", without the need to individually position the fastener portions in the mold with pins/plates which must be subsequently removed from the abrasive disc.

Having described various embodiments of the invention, fabrication thereof will now be described in conjunction with the following Table I. As shown, a suitable material, such as a glass-reinforced polyester, is formed 50 by molding and/or machining into a plate 40, 40' of desired size and shape. The plate is optionally provided 51 with one or more ledges 43 (e.g., a shape approximating a pentagon in cross-section or some other geometric cross-sectional shape for anchoring the plate to the abrasive disc) and/or gaps 43' to effect a mechanical interlock as discussed hereinabove.

Fastener portions 20', 20" are placed 52 within plate 40 along a predetermined hole pattern. The fastener portions (e.g., nuts, bolts or studs) may be either molded into the plate, or machined into the plate, e.g., by drilling and tapping holes.

The mounting plate may then be affixed 54 to an abrasive disc 30', optionally using 56 an adhesive such as GY6004 two-part epoxy (Vantico AG, Bassel Switzerland) applied either before molding, or after molding along with application of heat. Alternatively, a conventional self curing plate epoxy such as Epoweld 13230 (Elementis Specialties, Inc., Belleville, N.J., USA) may be used without application of heat, after molding disc 30'.

For example, in some applications, mounting plate 40 may be molded in-situ 58 with abrasive disc 30', by placing plate 40 into a suitably sized and shaped mold, along with a bond/abrasive mixture. Adhesive 42 may be optionally applied 56 to plate 40 prior to placement of the bond/abrasive mixture into the mold, to help effect a secure bond between the plate 40 and abrasive disc 30'. As a further option, ledges 43, if provided in step 51, may be used to effectively form 60 a mechanical interlock or 'key' to help secure plate 40, 40' to disc 30', e.g., as shown in FIG. 3. The plate and disc combination may then be cured 62 by heating.

TABLE I

| | |
|---|---|
| 50 | plate formed |
| 51 | plate optionally provided with ledge(s) 43 |
| 52 | Fastener portions 20', 20" placed into plate by molding or machining |
| 54 | plate affixed to abrasive disc 30' |
| 56 | optionally with adhesive, applied before or after disc molded |
| 58 | optionally by molding in-situ with disc |
| 60 | optionally forming mechanical interlock |
| 62 | disc cured by heating |

In the preceding specification, the invention has been described with reference to specific exemplary embodiments thereof. It will be evident that various modifications and changes may be made thereunto without departing from the broader spirit and scope of the invention as set forth in the claims that follow. The specification and drawings are accordingly to be regarded in an illustrative rather than restrictive sense.

The following illustrative examples are intended to demonstrate certain aspects of the present invention. It is to be understood that these examples should not be construed as limiting.

EXAMPLES

Example 1

Samples of a glass-reinforced polyester (Types 5300 and 5600 Sheet Molding Compound, Zehrco Plastics, Inc., Ashtabula Ohio, USA), fabricated as bars having ½ in×½ in (nominally 12 mm×12 mm) transverse cross-sections, were evaluated both before and after being baked at approximately 160° C. for ten hours, to evaluate thermal stability and mechanical properties.

The mechanical strength was tested by measuring the yield strength of samples of the material before and after bake. The yield strength was tested using an Instron®4204 (Instron Corporation, Canton, Mass.) electromechanical testing system equipped with an Instron® Three-Point Bend fixture with 2 inch (5 cm) span and a free moving roller, operated at a feed rate of 0.5 inch (1.3 cm) per minute. The material was found to substantially exceed the desired strength of 40 mega pascals (MPa), while also exceeding the optional strength level of 100 MPa, as shown in Table II below.

TABLE II

| | Stress at Yield (MPa): Without Bake | Stress at Yield (MPa): After Bake |
|---|---|---|
| Mean | 130.8 | 140.9 |
| StdDev | 29.1 | 19.2 |

The pull-out strength of a representative sample plate was tested using a conventional pull-out test in which a Tinius Olson™ (Tinius Olsen, Inc., Horsham, Pa.) mechanical testing device was used to measure the force required to pull a conventional ⅝-11 (Nominal Diameter and Threads Per Inch) bolt screwed in 0.5 inches (12.7 mm) into holes drilled and tapped in the material. Six holes were drilled and tapped in the sample before bake, and the force to remove a threaded screw was recorded. The pull out strength of the material far exceeded the desired minimum of 500 lbs (2224 Newtons), as shown in Table III below.

TABLE III

| Pull-Out Strength | |
|---|---|
| Hole # | lbs (Newtons) |
| 1 | 2045 (9097) |
| 2 | 1960 (8719) |
| 3 | 1935 (8607) |
| 4 | 1865 (8296) |
| 5 | 2060 (9163) |
| 6 | 2445 (10,876) |
| Average | 2052 (9128) |

These materials were used to fabricate a plurality of mounting plates 40 substantially as shown and described hereinabove with respect to FIGS. 3 & 4. All of these plates had a diameter of 18 inches (46 cm), some with, and some without a center hole 46. Several of the plates were molded in-situ with an abrasive disc 30' substantially as shown and described in FIG. 3.

The abrasive disc 30' was fabricated using an abrasive grain/vitrified binding material agglomerate substantially as described in Example 1 of U.S. Pat. No. 6,988,937 (the '937 patent). A vitrified binding material (Binder A from the '937 patent) was used to make agglomerated abrasive grain sample AV4 (A80-B493-1). Sample AV4 was similar to sample AV2 of the '937 patent (Table IV below), except that a commercial batch size was manufactured for sample AV4-1. The agglomerates were prepared according to the rotary calcination method described in U.S. Ser. No. 10/120,969, Example 1. The abrasive grain was a fused alumina 38A abrasive grain, 80 grit size, obtained from Saint-Gobain Ceramics & Plastics, Inc., Worcester, Mass., USA, and 3 wt. % Binder A was used. The calciner temperature was set at 1250° C., the tube angle was 2.5 degrees and the rotation speed was 5 rpm. The agglomerates were treated with 2% silane solution (obtained from Crompton Corporation, South Charleston, W. Va.).

TABLE IV

Abrasive Grain/Vitrified Binder Agglomerates

| Mix: grain, binding material | Weight lbs (kg) of mix | Wt % Abrasive Grain | Binding material Wt % | Volume % binding material[a] | LPD −20/+45 mesh fraction | size microns (mesh) | Average % relative density |
|---|---|---|---|---|---|---|---|
| AV2 80 grit 38A, Binder A[b] | 84.94 (38.53) | 94.18 | 2.99 | 4.81 | 1.036 | 500μ −20/+45 | 26.67 |

[a]The percentages are on a total solids basis, only include the vitrified binder material and abrasive grain, and exclude any porosity within the agglomerates. Temporary organic binder materials were used to adhere the vitrified bond to the abrasive grain (for AV2, 2.83 wt % AR30 liquid protein binder was used, and for AV3, 3.77 wt % AR30 liquid protein binder was used). The temporary organic binder materials were burned out during the sintering of the agglomerates in the rotary calciner and the final wt % binding material does not include them.

[b]Binder A (described in U.S. Ser. No. 10/120,969, Example 1) is a mixture of raw materials (e.g., clay and minerals) commonly used to make vitrified bonds for abrasive grinding wheels. Following agglomeration, the sintered glass composition of Binder A includes the following oxides (wt %): 69% glass formers ($SiO_2$ + $B_2O_3$); 15% $Al_2O_3$; 5-6% alkaline earth oxides RO (CaO, MgO); 9-10% Alkali $R_2O$ ($Na_2O$, $K_2O$, $Li_2O$), and has specific gravity of 2.40 g/cc and an estimated viscosity at 1180° C. of 25,590 Poise Agglomerate sample AV4 was used to make grinding wheels (finished size 18" diameter×3" width×10" center hole (type 1) (45.72×7.6×25.4 cm).

The experimental abrasive wheels were made with commercial manufacturing equipment by mixing the agglomerates with liquid phenolic resin (Durez Varcum 29-390 liquid resin obtained from Durez Corporation, Dallas Tx.) (10 wt % of bond mixture) powdered phenolic resin (Durez Varcum® resin 29-717 obtained from Durez Corporation, Dallas Tex.) (33 wt % of bond mixture) & Fluorspar (Seaforth Mineral & Ore Co. Inc.) (57 wt % of bond mixture). The weight percent quantities of abrasive agglomerate and resin bond used in these wheels are listed in Table V, below. The materials were blended for a sufficient period of time to get a uniform blend. The uniform agglomerate and bond mixture was placed into molds with the plates (placed at the bottom of the molds) and pressure was applied to form green stage (uncured) wheels. These green wheels were removed from the molds, wrapped in coated paper and cured by heating to a maximum temperature of 160° C., graded, finished, and inspected according to commercial grinding wheel manufacturing techniques known in the art. The wheels did not deform or crack during the molding process.

TABLE V

| A80-B493-1 (AV4) | WT % |
|---|---|
| Agglomerate | 0.8030 |
| Liquid Resin | 0.0194 |
| Powdered Resin | 0.0649 |
| Fluorspar | 0.1127 |
| Density | 1.8180 |

Some of the wheels were molded using adhesive material 42 (GY6004 two-part epoxy) applied to the plate 40. Other discs 30' were press molded and cured (baked) without a plate 40, which was then secured to the plate using conventional plate epoxy (Epoweld 13230).

These wheels were then successfully speed tested at 2600 rpm (12500 Surface Feet per Minute).

Other wheels are molded without adhesive material 42, using ledges 43 to mechanically capture the discs 30' to the plates.

Example 2

Samples of two compositions of glass-reinforced polyester (Premi-Glas® 1203-30, 30 percent glass filled polyester, Premix, Inc., North Kingsville Ohio) were fabricated as bars having transverse cross-sections of ½ in×½ in (nominally 12 mm×12 mm), and tested for yield strength and pull-out strength substantially as described in Example 1.

Both compositions were found to substantially exceed the desired minimum and optional yield strengths of 40 and 100 MPa, respectively, as shown in Table VI below.

TABLE VI

| | Composition 1 Stress at Yield (MPa) | Composition 2 Stress at Yield (MPa) |
|---|---|---|
| Mean | 264.9 | 212.7 |
| StdDev | 42.8 | 30.2 |

The pull out strength of the material far exceeded the desired minimum of 500 lbs (2224 Newtons), as shown in Table VII below.

TABLE VII

| Pull-Out Strength | | |
|---|---|---|
| Hole # | Sample 1: lbs (N) | Sample 2: lbs (N) |
| 1 | 3050 (13,567) | 1550 (6895) |
| 2 | 2910 (12944) | 1865 (8296) |
| 3 | 3195 (14212) | 1930 (8585) |
| 4 | 2975 (13233 | 1885 (8385) |
| 5 | 3520 (15658) | 1960 (8719) |
| 6 | 3405 (15146) | 1900 (8452) |
| Average | 3175 (14123) | 1848 (8220) |

A plurality of mounting plates 40 having 5 inch outer diameters were fabricated substantially as described in Example 1 from these two compositions of glass-reinforced polyester. In addition, abrasive discs 30' were fabricated using the aforementioned agglomerate sample AV4, having a finished size of 5" diameter×2" width×2" center hole (Type 1) (127×5.0×5.0 cm). These discs were made with commercial manufacturing equipment by mixing the agglomerates with liquid phenolic resin (Durez Varcum 29-390 liquid resin obtained from Durez Corporation, Dallas Tx.) (25 wt % of bond mixture) powdered phenolic resin (Durez Varcumg® resin 29-717 obtained from Durez Corporation, Dallas Tex.) (27 wt % of bond mixture) & Fluorspar (Seaforth Mineral & Ore Co. Inc.) (48 wt % of bond mixture). The weight percent quantities of abrasive agglomerate and resin bond used in these wheels are listed in Table VIII, below. The materials were blended for a sufficient period of time to get a uniform blend. The uniform agglomerate and bond mixture was placed into molds and pressure was applied to form green stage (uncured) wheels. These green wheels were removed from the molds, wrapped in coated paper and cured by heating to a maximum temperature of 160° C., graded, finished, and inspected according to commercial grinding wheel manufacturing techniques known in the art. The discs were secured to several of the plates 40 using Epoweld™ 13230 epoxy. These wheels were then successfully speed tested at over 11,000 Surface Feet per Minute.

TABLE VIII

| A80-B493-2 (AV4-2) | WT % |
|---|---|
| Agglomerate | 0.7960 |
| Liquid Resin | 0.0510 |
| Powdered Resin | 0.0559 |
| Fluorspar | 0.0971 |
| Density | 1.8180 |

Example 3

Samples of a glass reinforced polyester produced by Polyply Composites, Inc., of Grand Haven, Mich., were fabricated as bars having transverse cross-sections of ½ in×½ in (nominally 12 mm×12 mm), and tested for yield strength and pull-out strength substantially as described in Example 1, both before and after baking at approximately 160° C.

Test results shown in the following Tables IX-XI indicate that these samples meet the desired minimum yield strength of 40 mega pascals (MPa) and the desired minimum pull out strength of 500 lbs (2224 Newtons). Post-bake samples failed to meet the optional yield strength level of 100 MPa.

TABLE IX

| Before Bake | |
|---|---|
| Bar # | Stress at Yield (MPa) |
| 1 | 173.9 |
| 2 | 220.5 |
| 3 | 163.7 |
| Mean | 186 |
| Std Dev | 30.3 |

TABLE X

| After 76 Bake | |
|---|---|
| Bar # | Stress at Yield (MPa) |
| 1 | 60.3 |
| 2 | 92.5 |
| 3 | 172 |
| 4 | 159 |
| 5 | 76.2 |
| 6 | 92.8 |
| Mean | 108.8 |
| Std Dev | 45.7 |

TABLE XI

| Pull-out strength | 1" sample lbs (N) | ½" sample lbs (N) |
|---|---|---|
| 1 | 2885 (12834) | 2685 (11944) |
| 2 | 3060 (13612) | 2175 (9675) |
| 3 | 2880 (12811) | 2775 (12344) |
| 4 | 3050 (13568) | 2175 (9675) |
| 5 | 2880 (12811) | 2190 (9742) |
| 6 | 2950 (13123) | 2765 (12300) |
| Average | 2950 (13123) | 2544 (11317) |

A plurality of mounting plates 40 having 5 inch outer diameters were fabricated substantially as described in Example 2 from this glass-reinforced polyester. In addition, abrasive discs 30' were fabricated and secured to the plates 40 as also described in Example 2. These wheels were then successfully speed tested at over 14,000 Surface Feet per Minute as shown in Table XII.

TABLE XII

| Burst testing Results | | |
|---|---|---|
| Wheel Molded | Bursting speed | SFPM |
| 2" thick | 10800 rpm | 14490 |
| 1-½" think | 11600 rpm | 15544 |

Example 4

Mounting plates 40', substantially as shown and described with respect to FIGS. 5 & 6, including both metallic and non-metallic nuts 20" are fabricated and molded in-situ with an abrasive disc 30' in the manner described in Example 1, without the use of an adhesive 42.

The mounting plates are each single unitary components having a bolt pattern (fasteners 20") configured to match that of a grinder, and are placed at the bottom of a disc mold. The abrasive mix (abrasive, liquid & resin) is spread on top of the plate. The abrasive mix and plate are compression molded, baked, and finished in a conventional manner.

Example 5

Samples of a non-reinforced phenolic resin, and samples of a non-reinforced polyester resin (Leech Industries, Inc.) were fabricated as bars having transverse cross-sections of ½ in×½ in (nominally 12 mm×12 mm), and tested for yield strength (both pre- and post-bake) substantially as described in Example 1. Results are shown in the following Tables XIII and XIV.

TABLE XIII

| Bar # | Phenolic Stress at Yield (MPa) | Phenolic After Bake (160C.) Stress at Yield (MPa) |
|---|---|---|
| 1 | 76.8 | 82.9 |
| 2 | 110.8 | 103.6 |
| 3 | 95.1 | 107.6 |
| Mean | 94.3 | 98.0 |
| Std Dev | 17 | 133 |

TABLE XIV

| Bar # | Polyester as received Stress at Yield (MPa) | Polyester After Bake (160C.) Stress at Yield (MPa) |
|---|---|---|
| 1 | 100.3 | 114.7 |
| 2 | 99.1 | 116.4 |
| 3 | 98.2 | 113.2 |
| Mean | 99.2 | 114.8 |
| Std Dev | 1.1 | 1.6 |

These materials were shown to meet the desired minimum yield strength requirement of 40 MPa, but not the optional yield strength level of 100 MPa.

Example 6

Samples of glass reinforced polyester from Osborne Industries Inc. (Osborne, Kans.) were fabricated as bars having transverse cross-sections of ½ in×½ in (nominally 12 mm×12 mm), and tested for yield strength and pull-out strength substantially as described in Example 1. This material meets the desired minimum yield strength requirement of 40 MPa, but not the optional requirement of 100 MPa, as shown in the following Tables XV and XVI.

TABLE XV

| Bar # | Stress at Yield (MPa) |
|---|---|
| 1 | 93.4 |
| 2 | 98.2 |
| 3 | 77.4 |
| 4 | 86.7 |
| 5 | 84.2 |
| 6 | 72.6 |
| Mean | 85.4 |
| Std Dev | 9.6 |

TABLE XVI

| Pull-out strength | lbs (N) |
|---|---|
| 1 | 1915 (8519) |
| 2 | 1980 (8808) |
| 3 | 1955 (8697) |
| 4 | 1800 (8007) |

TABLE XVI-continued

| Pull-out strength | lbs (N) |
|---|---|
| 5 | 1825 (8118) |
| 6 | 1810 (8052) |
| Average | 1880 (8363) |

Example 7

Samples of glass reinforced polyester (A) (BMC 605™, from Bulk Molding Compounds, Inc.) and (B) a non-reinforced phenolic resin, and samples of (B) (Dielectrite 48-50-15% BMC™ from IDI Industrial Dielectrics, Inc., Noblesville, Ind.) were fabricated as bars having transverse cross-sections of ½ in×½ in (nominally 12 mm×12 mm), and tested for yield strength and pull-out strength substantially as described in Example 1. Results, shown in the following Tables XVII-XIX, indicate that several of the samples failed to meet the desired minimum yield strength requirement of 40 MPa.

TABLE XVII

| Bar # | Material A (BMC) Stress at Yield (MPa) |
|---|---|
| 1 | 56.4 |
| 2 | 69.5 |
| 3 | 79.3 |
| 4 | 27.9 |
| 5 | 63 |
| 6 | 59.5 |
| Mean | 59.3 |
| Std Dev | 17.4 |

TABLE XVIII

| Bar # | Material B (IDI) Stress at Yield (MPa) |
|---|---|
| 1 | 28.8 |
| 2 | 49.5 |
| 3 | 11.7 |
| 4 | 34.8 |
| 5 | 71.3 |
| 6 | 68.8 |
| 7 | 57.3 |
| 8 | 43.4 |
| Mean | 45.7 |
| Std Dev | 20.4 |

TABLE XIX

| Pull-out strength | Material A - BMC lbs (N) | Material B - IDI lbs (N) |
|---|---|---|
| 1 | 2010 (8941) | 1840 (8185) |
| 2 | 1605 (7140) | 1595 (7095) |
| 3 | 1845 (8207) | 1535 (6828) |
| 4 | 1545 (6873) | 1850 (8230) |
| 5 | 1750 (7785) | 1745 (7762) |
| 6 | 1820 (8096) | 1840 (8185) |
| Average | 1765 (7851) | 1735 (7718) |

What is claimed is:

1. A bonded abrasive grinding wheel, comprising:

a bonded abrasive disc including abrasive grain disposed within a bond matrix;

a mounting plate integrally fastened to said disc;

said mounting plate having a plurality of non-metallic first threaded fastener portions disposed in a predetermined pattern therein;

said mounting plate fabricated from a composition including a polymeric material;

said plurality of non-metallic first threaded fastener portions each configured for respective engagement with a plurality of second threaded fastener portions disposed along a face plate of a grinding machine.

2. The grinding wheel of claim 1, wherein said mounting plate is bonded to said disc.

3. The grinding wheel of claim 2, wherein said mounting plate is bonded to said disc using a cross-linked epoxy.

4. The grinding wheel of claim 1, wherein said mounting plate is mechanically fastened to said disc.

5. The grinding wheel of claim 4, wherein said mounting plate is mechanically captured onto said disc with a molded mechanical interlock.

6. The grinding wheel of claim 5, wherein said mounting plate comprises an interlock portion disposed to form said molded interlock upon engagement with said bonded abrasive.

7. The grinding wheel of claim 1, wherein said mounting plate is fabricated from a thermoset material.

8. The grinding wheel of claim 7, wherein said mounting plate comprises a fiber reinforced thermoset material.

9. The grinding wheel of claim 8, wherein said thermoset material comprises polyester.

10. The grinding wheel of claim 1, wherein said first threaded fastener portions comprise nuts embedded within said mounting plate.

11. The grinding wheel of claim 1, wherein said first threaded fastener portions comprise threaded bores disposed within said mounting plate.

12. The grinding wheel of claim 1, wherein said disc has a diameter ranging from about 5 inches (13 cm) to about 44 inches (112 cm).

13. The grinding wheel of claim 12, wherein said mounting plate has a diameter at least 50 percent that of said disc.

14. The grinding wheel of claim 13, wherein said mounting plate has a transverse cross-sectional area within a range of 5 to 27 percent that of said disc.

15. The grinding wheel of claim 13, wherein said mounting plate has a transverse cross-sectional area within a range of 40 to 100 percent that of said disc.

16. The grinding wheel of claim 13, wherein said mounting plate has a diameter at least 95 percent that of said disc.

17. The grinding wheel of claim 1, wherein said mounting plate is a compression molded mounting plate having a yield strength of at least 40 MPa as determined using a three-point bend fixture with 2 inch (5 cm) span and a free moving roller operated at a feed rate of 0.5 inch (1.3 cm) per minute.

18. The grinding wheel of claim 17, wherein said yield strength is at least 100 to at least 500 MPa.

19. The grinding wheel of claim 1, wherein each of said plurality of first threaded fastener portions has a pull-out strength of at least 500 to at least 1200 pounds (2224 to 5338 Newtons), for a ⅝-11 bolt screwed 0.5 inches (12.7 mm) deep.

20. The grinding wheel of claim 1, wherein said grinding wheel has a burst strength of at least 10560 surface feet per minute (3219 surface meters per minute).

21. The grinding wheel of claim 1, wherein said abrasive disc is molded onto said mounting plate.

22. The grinding wheel of claim 1, wherein said mounting plate comprises a plurality of elongated supports extending radially and circumferentially between said first fastener portions.

23. The grinding wheel of claim 22, wherein said elongated supports comprise a hub and spoke configuration.

24. A method of fabricating a grinding wheel, the method comprising:

(a) forming a mounting plate from a composition comprising a polymeric material;

(b) disposing a plurality of non-metallic first threaded fastener portions in a predetermined pattern along the mounting plate, the first threaded fastener portions each being configured for respective engagement with a plurality of second threaded fastener portions disposed along a face plate of a grinding machine;

(c) forming a bonded abrasive disc; and (d) integrally fastening the plate to the abrasive disc.

25. The method of claim 24, wherein said forming (c) comprises disposing a mixture of abrasive grain and bond material into a mold and molding the mixture to yield a formed abrasive disc.

26. The method of claim 25, wherein said integrally fastening (d) comprises molding the mounting plate in-situ with the abrasive disc and then thermally curing the formed abrasive disc to adhere the mounting plate to the abrasive disc.

27. The method of claim 26, wherein said integrally fastening (d) comprises applying an adhesive to a face of the mounting plate prior to molding the abrasive disc.

28. The method of claim 26, wherein said forming (a) comprises providing the mounting plate with an interlock portion configured for being engaged by the abrasive disc.

29. The method of claim 28, wherein said integrally fastening (d) comprises engaging the mixture of abrasive grain and bond material with the interlock portion during said molding, to form a mechanical interlock.

30. The method of claim 24, wherein said integrally fastening (d) comprises curing the formed abrasive disc and bonding the plate to the abrasive disc with an adhesive.

31. The method of claim 24, wherein said embedding (b) comprises molding the first fasteners into the mounting plate.

32. The method of claim 24, wherein said embedding (b) comprises machining the first fasteners into the mounting plate.

33. The method of claim 24, wherein said forming (a) comprises forming the mounting plate from a thermoset material.

34. The method of claim 33, wherein the thermoset material comprises a fiber reinforced material.

35. The method of claim 24, wherein said disc has a diameter ranging from about 5 inches (13 cm) to about 44 inches (112 cm).

36. The method of claim 24, wherein the mounting plate has a diameter at least 50 percent that of said disc.

37. The method of claim 36, wherein the mounting plate has a diameter at least 95 percent that of said disc.

38. The method of claim 24, wherein the grinding wheel has a yield strength of at least 40 to at least 100 MPa.

39. The method of claim 24, wherein the first threaded fastener portions have a pullout strength of at least 500 to at least 1200 pounds (2224 to 5338 Newtons).

40. The method of claim 24, wherein the grinding wheel has a burst strength of at least 10560 surface feet per minute (3219 surface meters per minute).

41. The method of claim 24, wherein forming (a) comprises forming the mounting plate as a plurality of elongated supports extending radially and circumferentially between the first fastener portions.

42. The method of claim 41, wherein the elongated supports comprise a hub and spoke configuration.

43. The method of claim 24, wherein the disc plate and grinding wheel are cured by heating after being fastened to one another with an adhesive.

44. A bonded abrasive grinding wheel, comprising:

a bonded abrasive disc including abrasive grain disposed within a bond matrix;

a mounting plate fabricated from a composition comprising a polymeric material and integrally fastened to said abrasive disc;

said mounting plate having a plurality of non-metallic first threaded fastener portions machined in a predetermined pattern therein, each of said fastener portions configured for respective engagement with a plurality of second threaded fastener portions disposed along a face plate of a grinding machine;

said disc having a diameter ranging from:

about 5 inches (13 cm); to about 44 inches (112 cm);

said mounting plate having a yield strength of at least 40 MPa;

said plurality of first threaded fastener portions each having a pullout strength of at least 500 pounds (2224 Newtons); and said grinding wheel having a burst strength of at least 10560 surface feet per minute (3219 surface meters per minute).

* * * * *